US011345529B2

(12) United States Patent
Sawicki

(10) Patent No.: US 11,345,529 B2
(45) Date of Patent: May 31, 2022

(54) PACKAGING INSERT FOR INDIVIDUAL CONTAINERS

(71) Applicant: TricorBraun Inc., St. Louis, MO (US)

(72) Inventor: Craig Sawicki, Roselle, IL (US)

(73) Assignee: TricorBraun Inc., St. Louis, MO (US)

( * ) Notice: Subject to any disclaimer, the term of this patent is extended or adjusted under 35 U.S.C. 154(b) by 256 days.

(21) Appl. No.: 16/448,905

(22) Filed: Jun. 21, 2019

(65) Prior Publication Data

US 2019/0389640 A1 Dec. 26, 2019

Related U.S. Application Data

(60) Provisional application No. 62/688,647, filed on Jun. 22, 2018.

(51) Int. Cl.
*B65D 71/70* (2006.01)
*B65D 71/50* (2006.01)

(52) U.S. Cl.
CPC ..... *B65D 71/70* (2013.01); *B65D 71/50* (2013.01)

(58) Field of Classification Search
CPC ..... B65D 71/70; B65D 71/50
USPC ..... 206/427, 433, 203; 229/407; 220/512, 220/513, 514, 509
See application file for complete search history.

(56) References Cited

U.S. PATENT DOCUMENTS 2,758,742 A * 8/1956 Farrell ..... B65D 1/243 220/511
3,351,264 A * 11/1967 Bostrom ..... B65D 71/70 229/120.32
3,509,993 A * 5/1970 Michel ..... B65D 85/324 206/433
3,894,679 A * 7/1975 Reiters ..... B65D 1/34 229/407
3,986,655 A * 10/1976 Rynning ..... B65D 1/34 229/407
4,037,722 A * 7/1977 Bremer ..... B65D 81/113 206/523
4,442,969 A * 4/1984 Holden ..... B65D 1/34 220/608
4,899,874 A 2/1990 Apps et al.
4,899,875 A 2/1990 Apps et al.
4,911,300 A 3/1990 Colonna
(Continued)

FOREIGN PATENT DOCUMENTS

EP 2815991 B1 12/2016

*Primary Examiner* — Jacob K Ackun
(74) *Attorney, Agent, or Firm* — Husch Blackwell LLP

(57) ABSTRACT

An insert configured for packaging of individual containers having top and bottom portions of different sizes includes a base structure having first and second planes separated by a distance; a plurality of identical base members extending between the first and second planes of the base structure, the base members being evenly distributed about the base structure, each base member further comprising: an outer well open to the first plane and having an at least partial side wall and a bottom surface, the outer well configured to accommodate a larger of the top and bottom portions of one of the glass containers; and an inner well open to the first plane and arranged concentrically within the outer well, the inner well configured to accommodate a smaller of the top and bottom portions of one of the glass containers. An associated method of packaging individual containers is also described.

11 Claims, 11 Drawing Sheets

(56) References Cited

U.S. PATENT DOCUMENTS 5,018,623 A * 5/1991 Hrenyo ..... B65D 1/34 206/497
5,038,961 A 8/1991 Watanabe et al.
5,377,862 A 1/1995 Oakes et al.
5,975,300 A 11/1999 Gale
6,149,053 A * 11/2000 Chatterton ..... B65D 1/26 220/608
6,290,057 B1 * 9/2001 Hurley ..... B65D 5/503 206/203
6,325,210 B1 * 12/2001 Henry, Jr. ..... B65D 5/503 206/203
6,367,645 B1 * 4/2002 Trygg ..... B65D 21/0231 220/513
6,474,473 B2 11/2002 Wong
6,513,675 B1 * 2/2003 Brown ..... B65D 1/34 220/608
6,527,116 B1 * 3/2003 Gale ..... B65D 5/503 206/427
6,820,743 B2 11/2004 Hurley et al.
8,434,620 B2 * 5/2013 Hall ..... B65D 5/48038 206/433
8,844,718 B2 * 9/2014 Hall ..... B65B 21/02 206/433
8,887,916 B2 11/2014 Gilfert et al.
8,895,092 B1 * 11/2014 Field ..... B65B 25/06 426/129
10,000,321 B2 6/2018 Kelly et al.
2005/0139500 A1 * 6/2005 Smithers ..... B65D 71/50 206/427
2008/0302691 A1 12/2008 Olson
2009/0108002 A1 * 4/2009 Delbrouck ..... B65D 19/42 220/519
2011/0024318 A1 * 2/2011 Gilfert ..... B65D 5/503 206/433
2011/0278187 A1 * 11/2011 Yang ..... B65D 71/70 206/427
2012/0037529 A1 * 2/2012 Hall ..... B65D 81/133 206/433

* cited by examiner

PACKAGING INSERT FOR INDIVIDUAL CONTAINERS

CROSS REFERENCE TO RELATED APPLICATIONS

This application claims the benefit of U.S. Provisional Application No. 62/688,647, filed Jun. 22, 2018, which is hereby incorporated by reference in its entirety.

TECHNICAL FIELD OF THE INVENTION

The present invention relates generally to packaging materials, and more particularly, to packaging inserts for securing wine bottles and other glass containers within packaging for shipping and/or storage.

BACKGROUND OF THE INVENTION

Wine, other alcohols, and other liquids contained in bottles, like wine bottles, are routinely stored and shipped around the world. Currently, bottles, particularly glass bottles, are simply placed in a standing position adjacent to one another within a container, most often a cardboard box. Then, the adjacent bottles of wine are separated by thin cardboard "X-fold separators" that help to cushion the bottles from one another. Foam may be (but is not always) placed above and/or below the bottles to further help cushion the bottles during shipping and storage in an effort to reduce breakage and damage to the bottles.

The above described system has long been used, and it is inexpensive. However, it allows for movement of wine bottles relative to one another. Moreover, it is difficult for a recipient of the wine shipment upon arrival of the shipment to know whether the contents have been tampered with.

Thus, it would be advantageous to provide packaging that allows for better internal protection for bottles within a container without introducing significant additional cost. The internal packaging should securely contain fragile bottles, with little to no movement of the wine bottles, to reduce breakage and damage to the bottles. The bottle packaging also should be provided in a way that allows recipients of shipments to easily determine if their shipment has been tampered with.

SUMMARY OF THE INVENTION

An aspect of the present disclosure is to provide an insert configured for packaging of individual containers having top and bottom portions of different sizes that includes a base structure having first and second planes separated by a distance; a plurality of identical base members extending between the first and second planes of the base structure, the base members being evenly distributed about the base structure, each base member further comprising: an outer well open to the first plane and having an at least partial side wall and a bottom surface, the outer well configured to accommodate a larger of the top and bottom portions of one of the individual containers; and an inner well open to the first plane and arranged concentrically within the outer well, the inner well configured to accommodate a smaller of the top and bottom portions of one of the individual containers.

Another aspect of the present disclosure is to provide an insert configured for packaging of individual containers having top and bottom portions of different diameters that includes a base structure having first and second planes separated by a distance; a plurality of identical base members extending between the first and second planes of the base structure, the base members being evenly distributed about the base structure, each base member further comprising: an outer well open to the first plane, being generally cylindrical and having an at least partial cylindrical side wall and a bottom surface, the outer well configured to accommodate a larger of the top and bottom portions of one of the individual containers; and a raised annular rib formed in the bottom surface of the outer well and arranged concentrically within the outer well, the inner well being open to the first plane and configured to accommodate a smaller of the top and bottom portions of one of the individual containers; and a plurality of horizontally oriented support rib formed in the bottom surface of the base member and extending in a radial direction between a center portion of the bottom surface and the cylindrical side wall.

In yet another aspect of the disclosure there is provided a method of packaging individual containers having top and bottom portions of different diameters, that includes the steps of providing a plurality of inserts including a base structure having first and second planes separated by a distance; a plurality of identical base members extending between the first and second planes of the base structure, the base members being evenly distributed about the base structure, each base member further comprising: an outer well open to the first plane, being generally cylindrical and having an at least partial cylindrical side wall and a bottom surface, the outer well configured to accommodate a larger of the top and bottom portions of one of the individual containers; and a raised annular rib formed in the bottom surface of the outer well and arranged concentrically within the outer well, the inner well being open to the first plane and configured to accommodate a smaller of the top and bottom portions of one of the individual containers; and a plurality of horizontally oriented support rib formed in the bottom surface of the base member and extending in a radial direction between a center portion of the bottom surface and the cylindrical side wall; placing a first insert into one end of a shipping container with the first plane of the first insert facing an interior of the shipping container; placing at least one of the individual containers in the first insert with either the top or bottom portions of each individual container being inserted into one of the base members of the first insert; and placing a second insert into the opposite end of the shipping container with the first plane of the second insert facing the interior of the shipping container with the opposite end of each individual container being inserted into the of the base members of the second insert.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION

Figure 1:
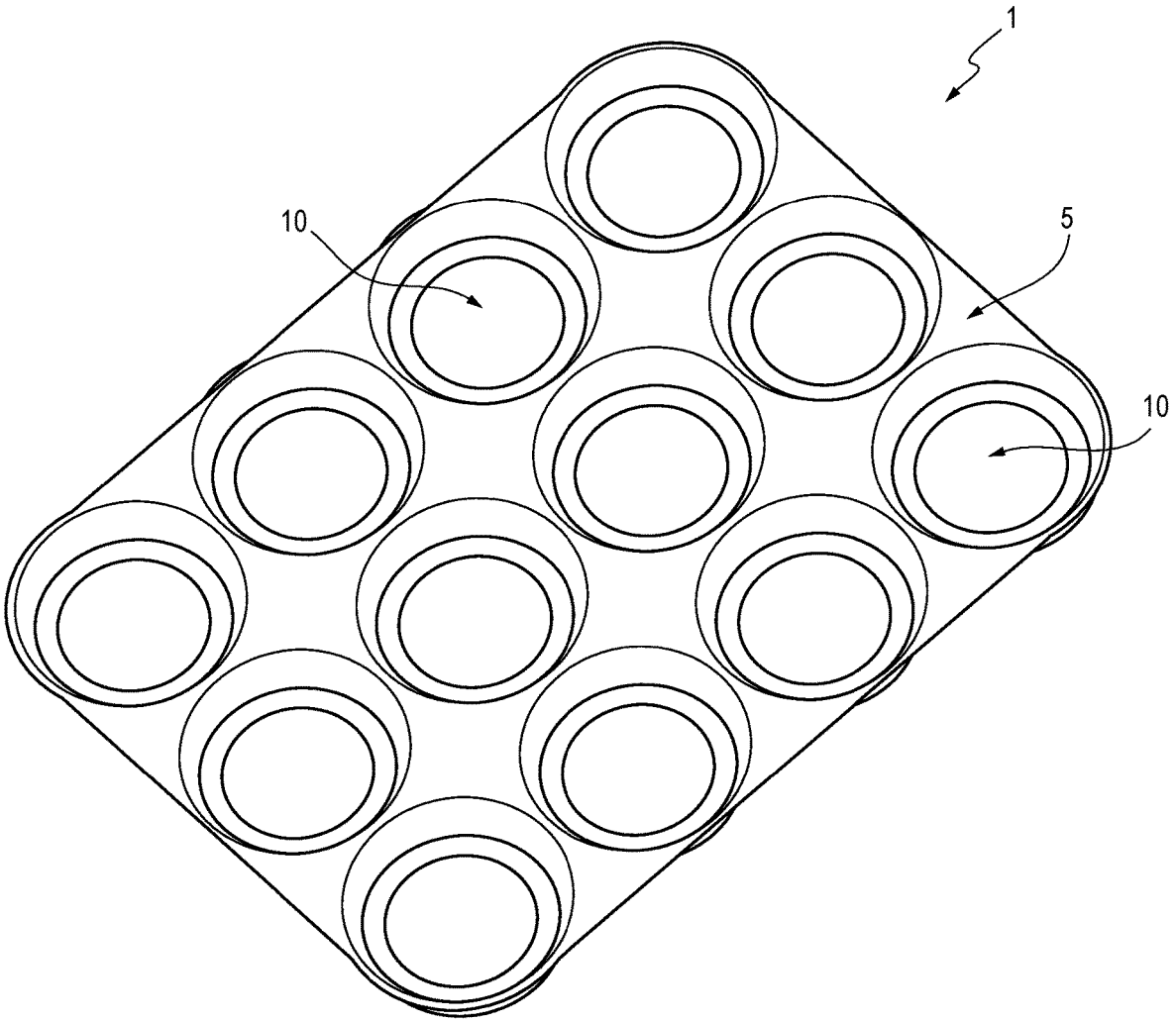
FIG. 1 is a perspective view of a first side of a packaging insert constructed according to an example embodiment of the present disclosure.

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention. The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. The following definitions and non-limiting guidelines must be considered in reviewing the description of the technology set forth herein.

The headings (such as "Introduction" and "Summary") and sub-headings used herein are intended only for general organization of topics within the present disclosure, and are not intended to limit the disclosure of the technology or any aspect thereof. In particular, subject matter disclosed in the "Introduction" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

The citation of references herein does not constitute an admission that those references are prior art or have any relevance to the patentability of the technology disclosed herein. All references cited in the "Description" section of this specification are hereby incorporated by reference in their entirety.

The description and specific examples, while indicating embodiments of the technology, are intended for purposes of illustration only and are not intended to limit the scope of the technology. Moreover, recitation of multiple embodiments having stated features is not intended to exclude other embodiments having additional features, or other embodiments incorporating different combinations of the stated features. Specific examples are provided for illustrative purposes of how to make and use the apparatus and systems of this technology and, unless explicitly stated otherwise, are not intended to be a representation that given embodiments of this technology have, or have not, been made or tested.

As used herein, the word "include," and its variants, is intended to be non-limiting, such that recitation of items in a list is not to the exclusion of other like items that may also be useful in the materials, compositions, devices, and methods of this technology. Similarly, the terms "can" and "may" and their variants are intended to be non-limiting, such that recitation that an embodiment can or may comprise certain elements or features does not exclude other embodiments of the present technology that do not contain those elements or features.

"A" and "an" as used herein indicate "at least one" of the item is present; a plurality of such items may be present, when possible. "About" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. In addition, disclosure of ranges includes disclosure of all distinct values and further divided ranges within the entire range.

Turning first to FIGS. 1-5, a packaging container insert 1 (referred to hereinafter simply as "insert 1") is shown constructed according to the teachings set forth below. An insert such as the insert 1 is preferably used with another insert in the manner described below to store and ship bottles and other containers having ends with different sizes.

More particularly, the insert 1 has first 5 and second 15 sides, which in turn are defined by first and second planes that are separated by the other by a distance that represents the thickness of the insert 5. More particularly, because neither the first 5 nor second 15 sides have a flat uniform surface, the planes of each side are further defined by the common height of the tallest features on each side. The first side 5 of the insert 1 preferably includes a plurality of base members 10, into which a base portion of a bottle may be secured when bottles are placed in the insert 1. The embodiment of the insert 1 shown in FIGS. 1-5 includes twelve base members 10, but in alternative embodiments may include more or fewer base members, depending on the number of bottles a user wishes to store in each insert 1.

Figure 2:
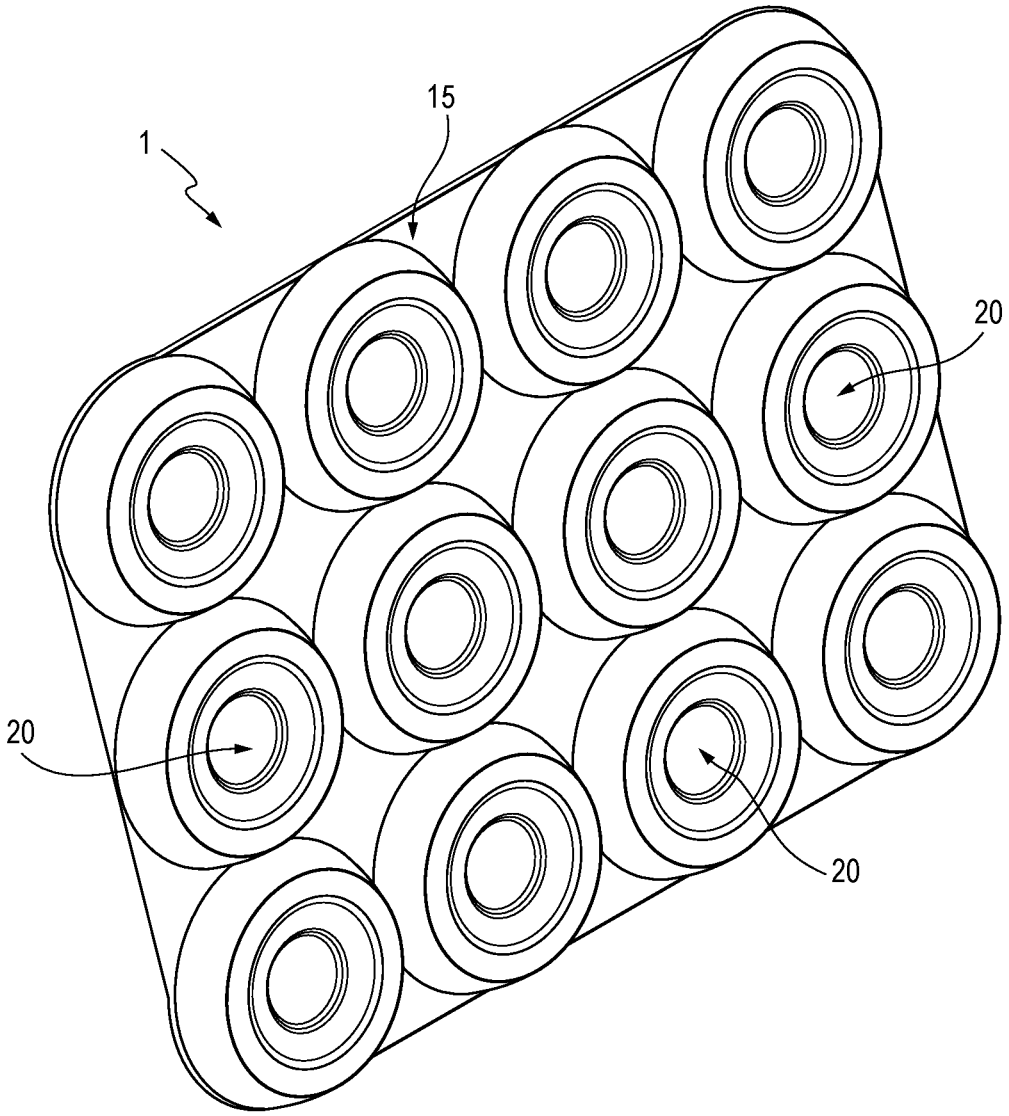
FIG. 2 is a perspective view of a second side of the packaging insert of FIG. 1.

FIG. 2 illustrates the second side 15 of the insert 1. The second side 15 preferably includes a plurality of neck members 20, into which top portions of bottle necks may be secured when bottles are placed in the insert 1. Just as the first side 5 includes twelve base members 10 in FIG. 1, the second side 15 preferably includes twelve neck members 20 in FIG. 2. In alternative embodiments where more or fewer neck members 20 are provided on the second side 15, the same number of base members 10 is preferably provided on the first side 5 as on the second side 15.

Two inserts 1 may be used together to secure and contain bottles or other similarly shaped vessels within a container, like a cardboard box. When the inserts 1 are used to secure bottles, two inserts 1 are preferably placed opposed to one another such that the first side 5 of an insert faces the second side of another insert 1. In that manner, bottles may be secured adjacent to one another with each wine bottle having its rounded base secured in a base member 10 and its top portion (located where the cork is traditionally placed) secured in a neck member 20. Thus, when several wine bottles are placed in adjacent inserts 1 for storage and/or shipment, each bottle is preferably placed in a base member 10 at one end and a neck member 20 at its other end.

When a container or crate is ready for shipment, the inserts 1 that are preferably securing the bottles therein may be shrink-wrapped in order to better secure the bottles therein. The shrink-wrapping may also act as tampering evidence if the wrapping has been tampered with when the shipment is received by a recipient.

Figure 3:
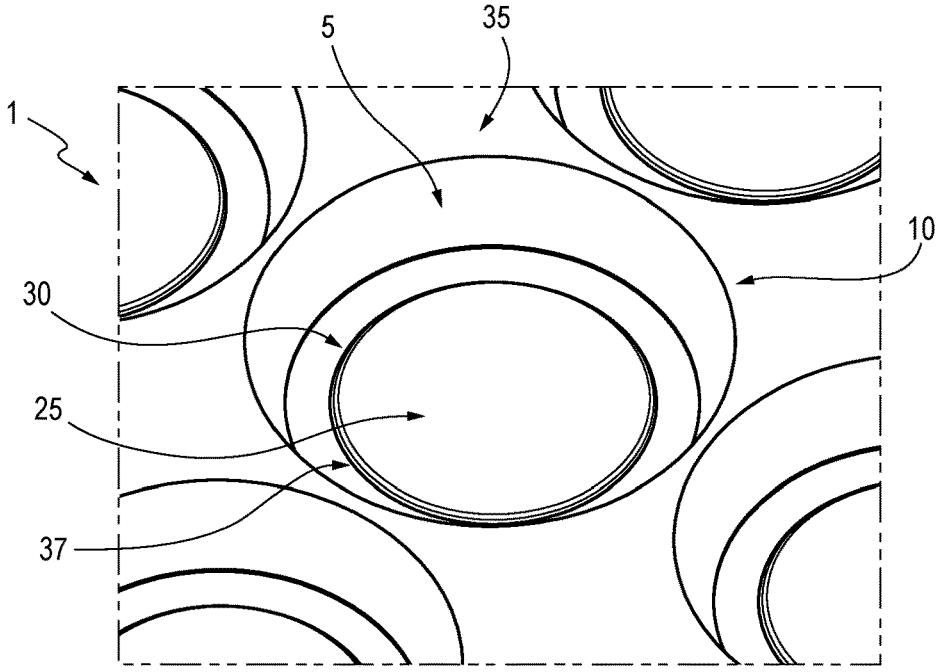
FIG. 3 is an enlarged perspective view of a portion of the first side of the packaging insert of FIG. 1.
Figure 4:
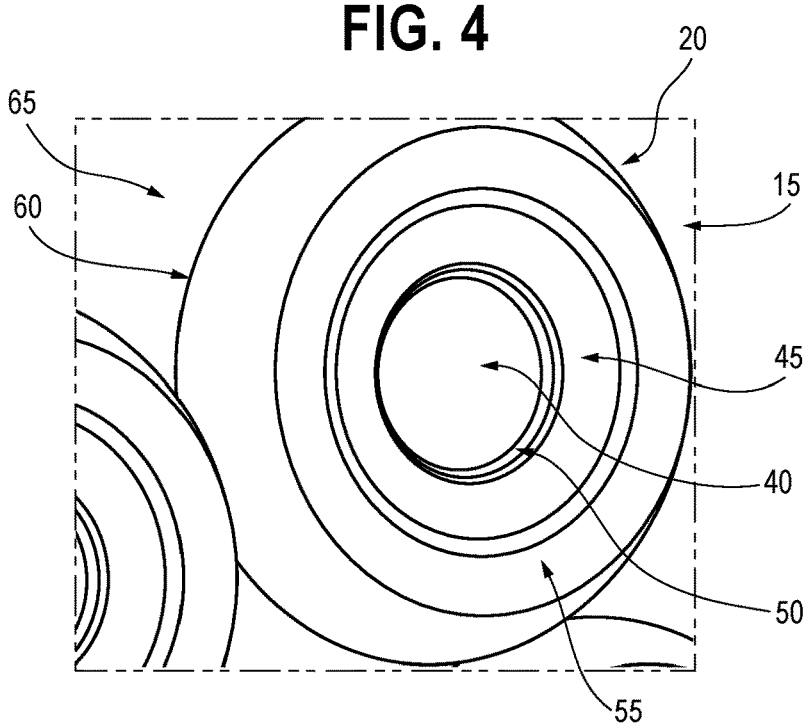
FIG. 4 is an enlarged perspective view of a portion side of the second side of the packaging insert of FIG. 2.
Figure 5:
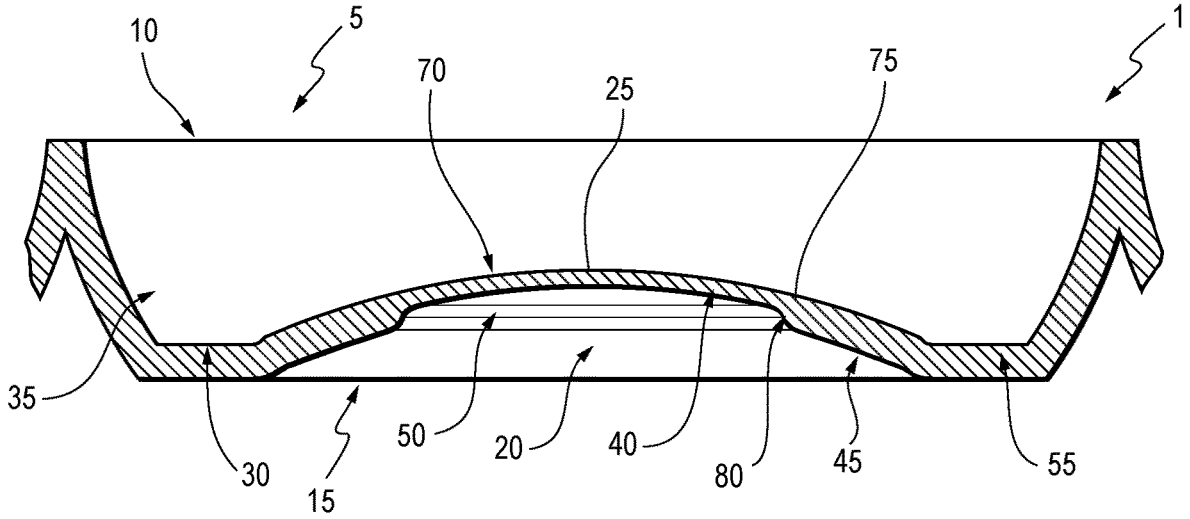
FIG. 5 is a cross-section view of the packaging insert of FIGS. 1 and 2.

In FIGS. 3 and 5, a base member 10 of the first side 5 of an insert 1 is illustrated in greater detail. At its center, each base member 10 preferably includes a moderately raised, domed portion 25 extending upwardly from the base member 10. The domed portion 25 is preferably surrounded by a channeled recess 30 that circumscribes the domed portion 25. The domed portion 25 may serve a purpose that is described in greater detail below.

The channeled recess 30 has a circumference that is only slightly larger than a wine bottle base's typical circumference. As such, a bottom portion of a wine bottle (not illustrated), having a circumference protruding downwardly therefrom, is preferably able to snugly fit into the channeled recess 30. Such bottles, for example, wine bottles, having a bottom portion with a protruding circumference is long known and understood in the art.

The wine bottle is also preferably secured by an interior wall 35 of the base member 10 that extends upwardly from, and circumscribes, a bottom portion 37 of the base member 10. As shown in FIG. 3 (and further shown in the cross-section of FIG. 5), the interior wall 35 preferably is shaped and sized to abut and further secure a lower portion of a bottle (not illustrated) when it is placed within the base member 10.

It should be noted that the domed portion 25 may serve a practical purpose when a bottle of wine is stored in the base member 10. More particularly, it may be received by a punt, also known as a kick-up, located at the bottom of a traditional wine bottle so that the punt abuts the domed portion 25 when it is received by the base member 10. Movement of the wine bottle within the base member 10 may be further reduced by the domed portion 25 abutting the wine bottle's punt. This further may help to reduce breakage and damage to wine bottles stored in the first side 5 of the insert 1.

In the same manner that a bottom portion of a bottle may be secured in the base member 10 of an insert 1, the top portion of the same bottle may be secured in a neck member 20 of an insert 1 placed opposite the first insert 1. A single neck member 20 is illustrated in greater detail in FIG. 4, and in FIG. 5, where details of each the first side 5 and the second side 15 of the insert 1 are illustrated.

Each neck member 20 preferably includes at its center portion a bottle top cavity 40 for receiving and securing the top of a bottle therein. The top cavity 40 preferably has a circumference and shape only slightly larger than that of the top of a typical bottle (where its cork is typically located and accessible). Because the top cavity 40 is preferably sized and shaped as described, it may securely and snugly fit the top of a bottle therein. As such, when the bottom of a bottle is preferably secured in the base member 10, the top of that same bottle may be secured in the neck member 20.

A circumferential ring 45 preferably circumscribes the top cavity 40. The circumferential ring 45 preferably follows the contour of the domed portion 25 of the base member 10 because it is opposite from the domed portion 25. In other words, the circumferential ring 45 acts substantially as the inverse of the domed portion 25.

In some embodiments, a step portion 50 may connect the top cavity 40 to the circumferential ring 45. Like the circumferential ring 45, the step portion 50 may circumscribe the top cavity 40 so that the neck member 20 may maintain its symmetry. In a preferred embodiment, the step portion 50 tapers outwardly from the top cavity 40 toward the circumferential ring 45. Yet, in alternative embodiments, the step portion 50 may be non-existent, substantially straight, or even tapered inwardly.

Moreover, the neck member 20 may include a rim portion 55 that substantially circumscribes the circumferential ring 45. The rim portion 55 is preferably flat, but in alternative embodiments, it may be raised or recessed. The rim portion 55 preferably attaches the circumferential ring 45 to an exterior wall 60 that surrounds, in a circular manner, the neck member 20. The exterior wall 60 preferably projects outwardly from the insert 1. As a result, the exterior wall 60 preferably helps to space adjacent bottles contained within neck members 20 within the insert 1 from one another. Preferably, this helps reduce damage caused to bottles by bumping into one another. In the illustrated embodiment, the exterior wall 60 preferably tapers outwardly from the rim portion downwardly toward a flat surface 65 of the insert 1.

It should be noted that a first thickness 70 where the top cavity 40 and domed portion 25 abut one another is less than a second thickness 75 where the circumferential ring 45 and the domed portion 25 abut one another. A thickness difference embodied as thickness 80 between the thicknesses 70, 75 may be due to the thickness 75 being reduced to the thickness 70 to create the top cavity 40. The top cavity 40 may include this reduced thickness 70 compared to the thickness 75 so that the top portion of a wine bottle may be retained therein, as described above.

Figure 6:
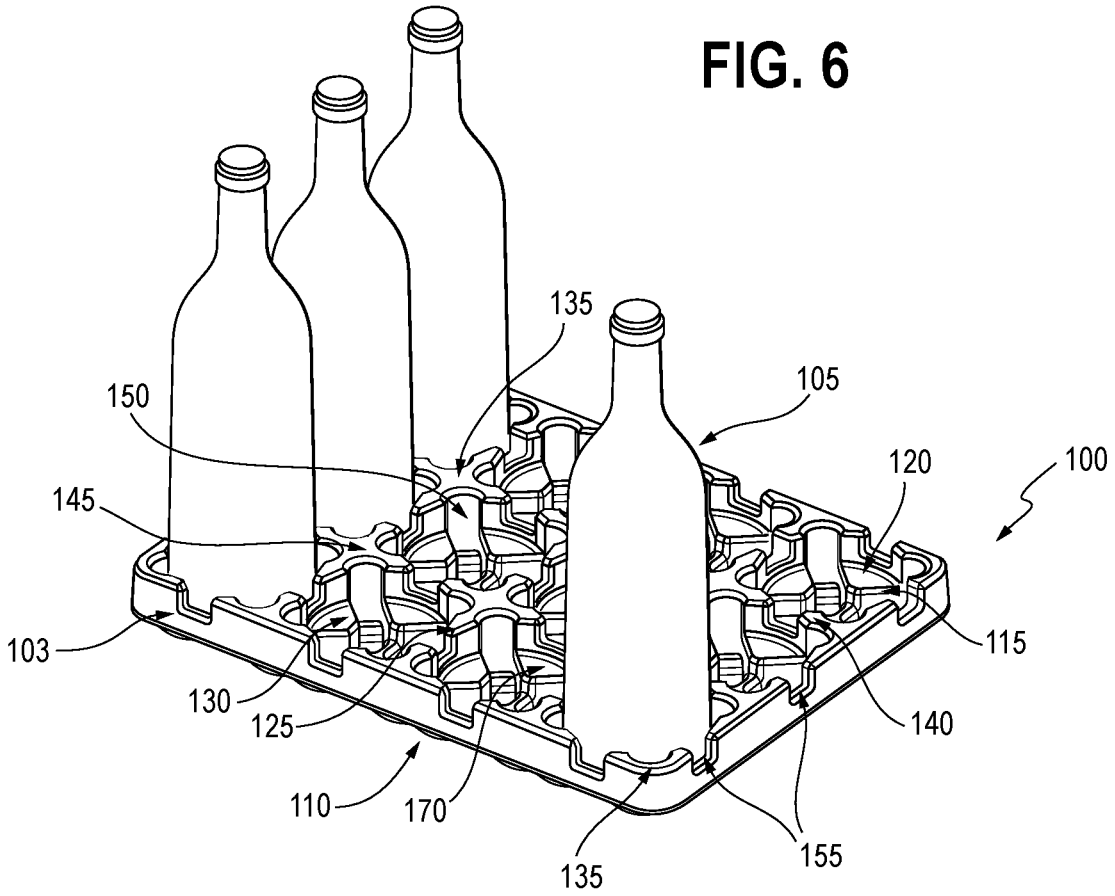
FIG. 6 is a perspective view of another packaging insert according to the present disclosure with multiple individual containers inserted therein.
Figure 7:
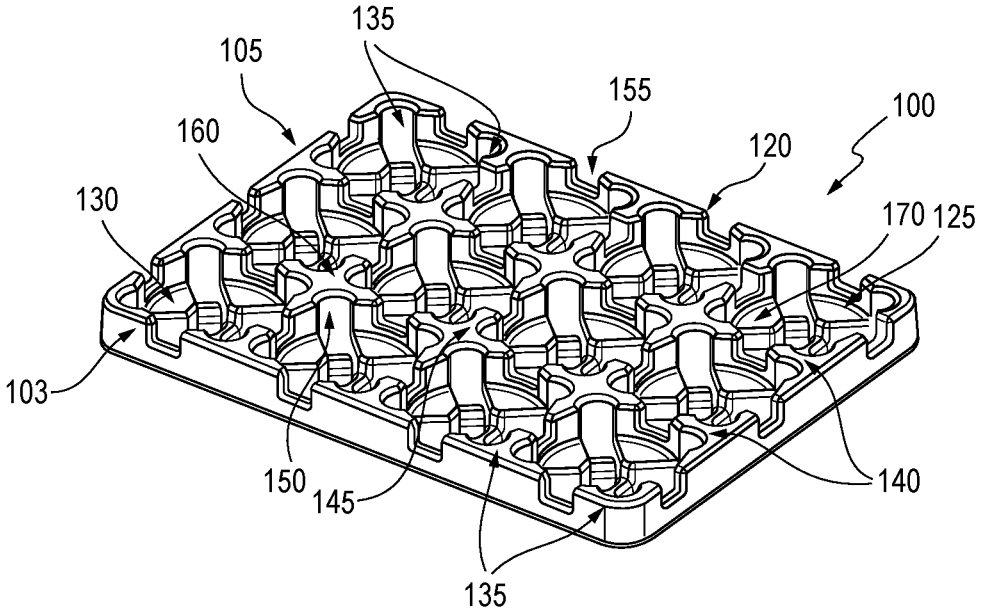
FIG. 7 is a perspective view of the packaging insert of FIG. 6.
Figure 8:
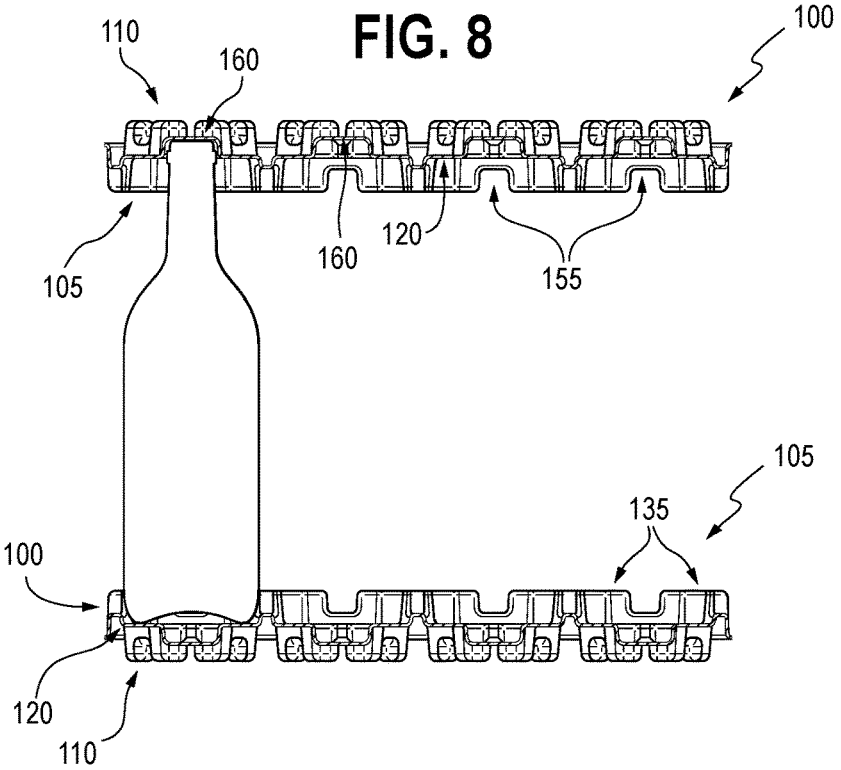
FIG. 8 is a cross-sectional view of a pair of the packaging insert of FIGS. 6 and 7 operating in combination to hold an individual container.
Figure 9:
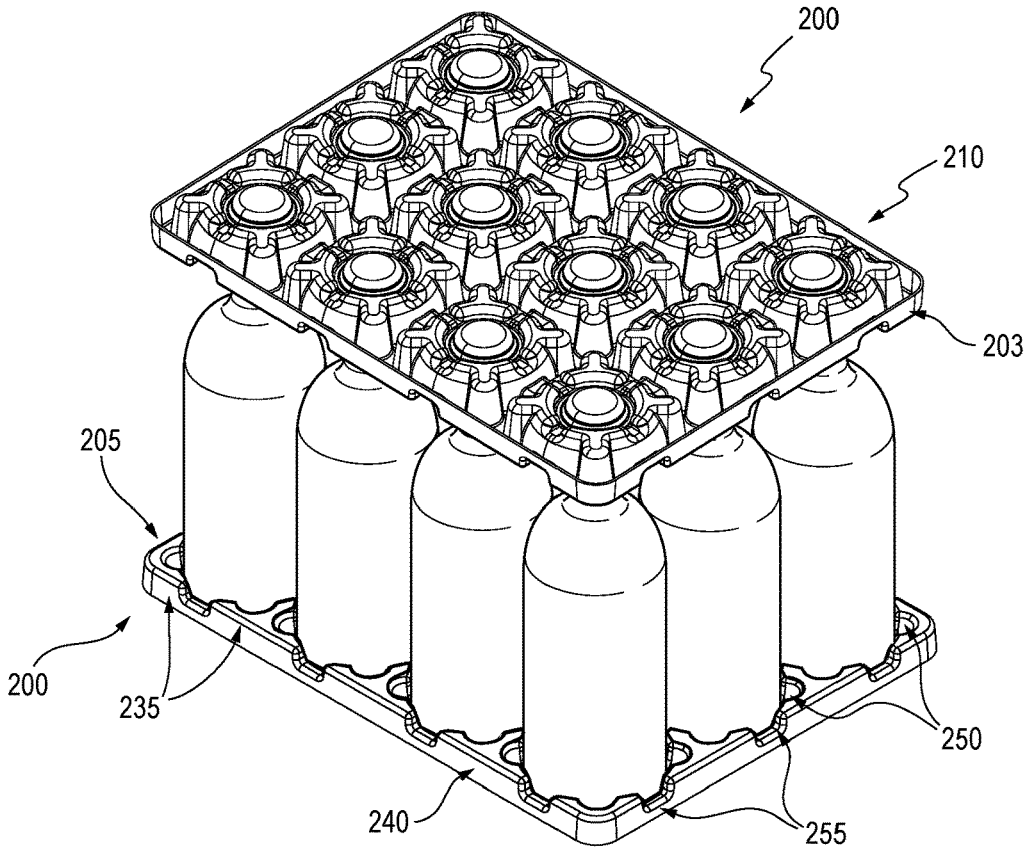
FIG. 9 is a perspective view of a a pair of a different embodiment of packaging inserts according to the present disclosure having received a plurality of wine bottles.
Figure 10:
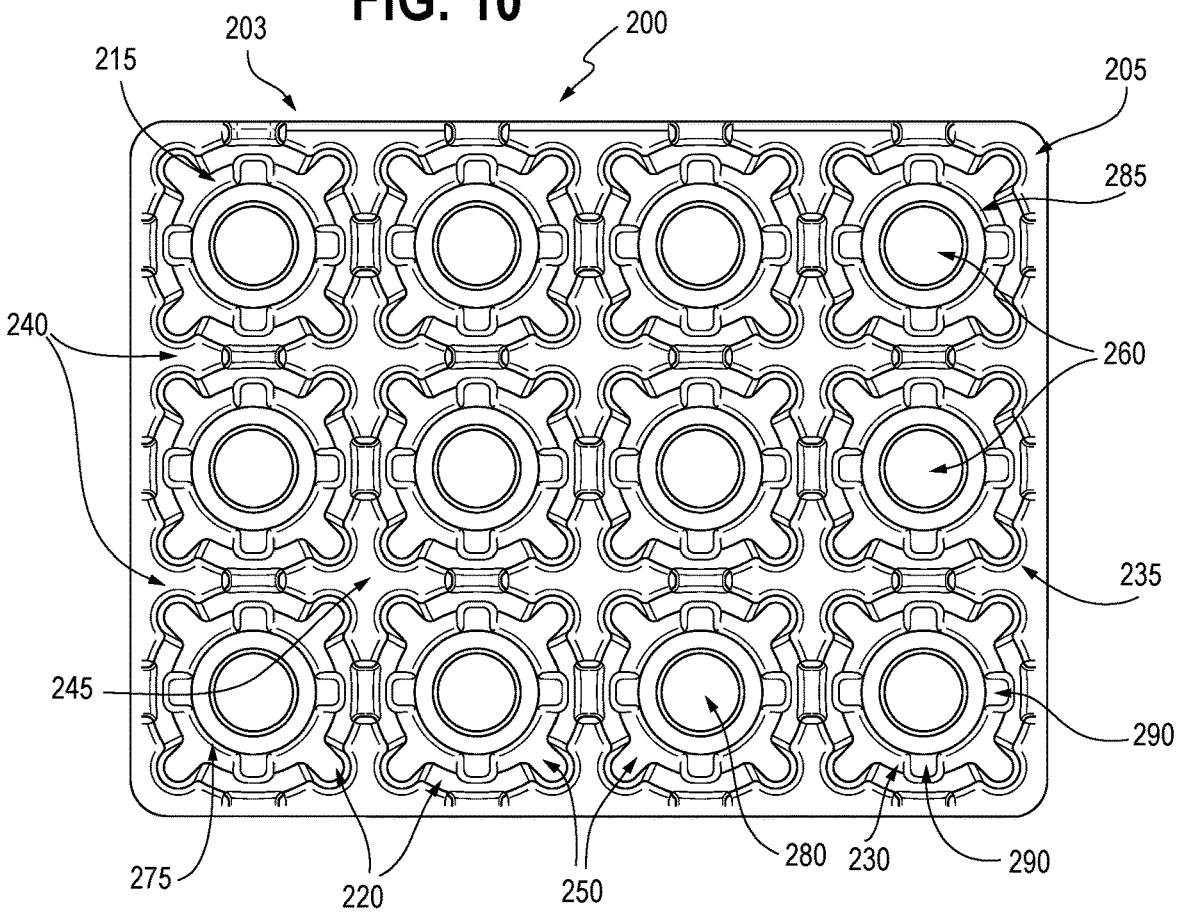
FIG. 10 is a plan view of a first side of the packaging insert of FIG.
Figure 11:
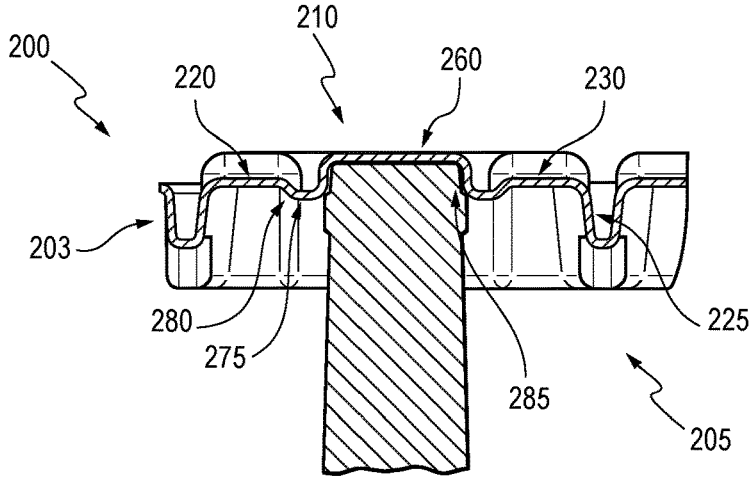
FIG. 11 is a cross-sectional view of the packaging insert of FIGS. 9 and 10 with a neck portion of an individual container inserted into the inner well of the insert.
Figure 12:
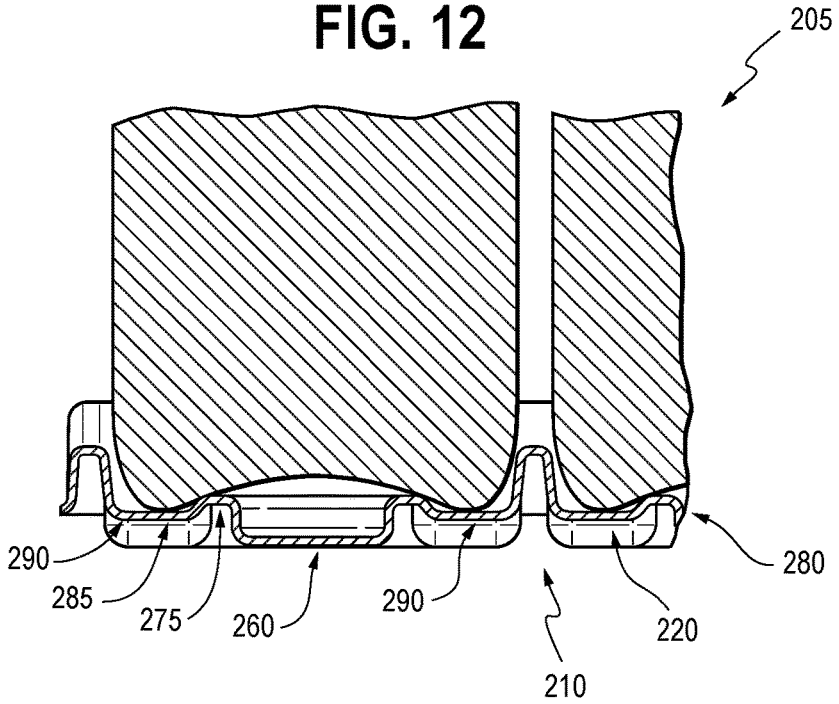
FIG. 12 is a cross-sectional view of the packaging insert of FIGS. 9 and 10 with a base portion of an individual container inserted into the outer well of the insert.
Figure 13:
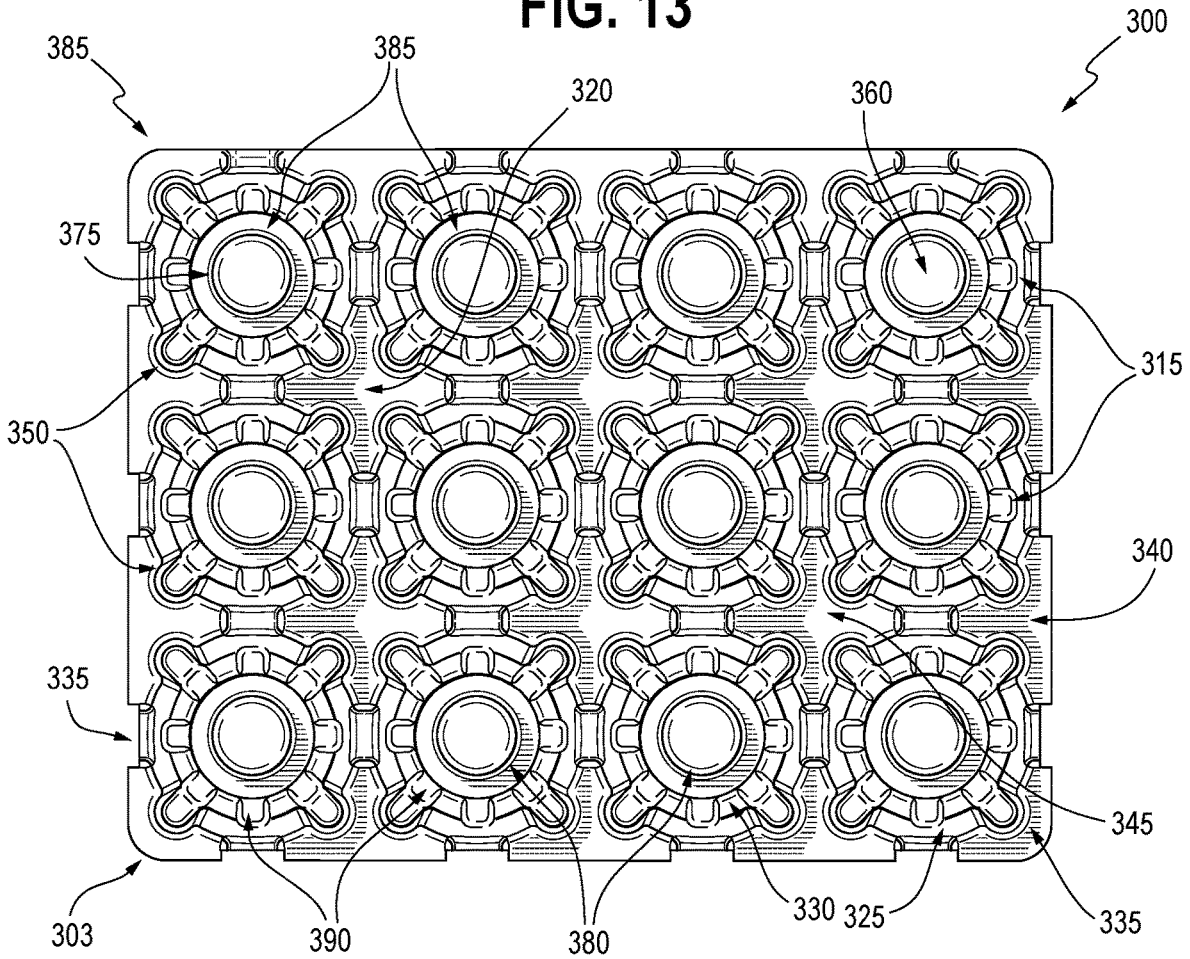
FIG. 13 is a plan view of a first side of a wine insert as shown in FIG. 13.
Figure 14:
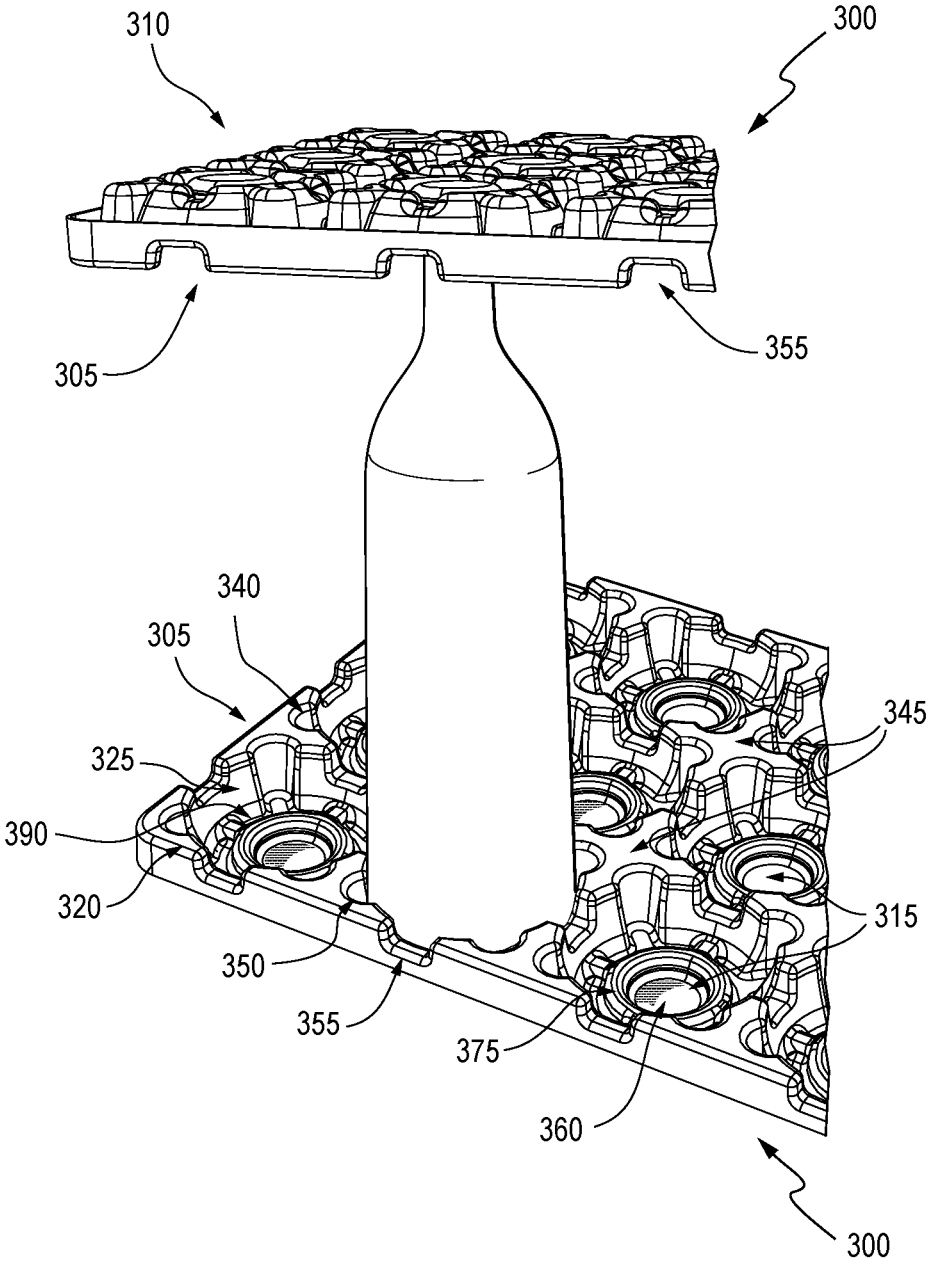
FIG. 14 is a perspective view of a pair of a different embodiment of packaging inserts according to the present disclosure operating in combination to hold an individual container.
Figure 15:
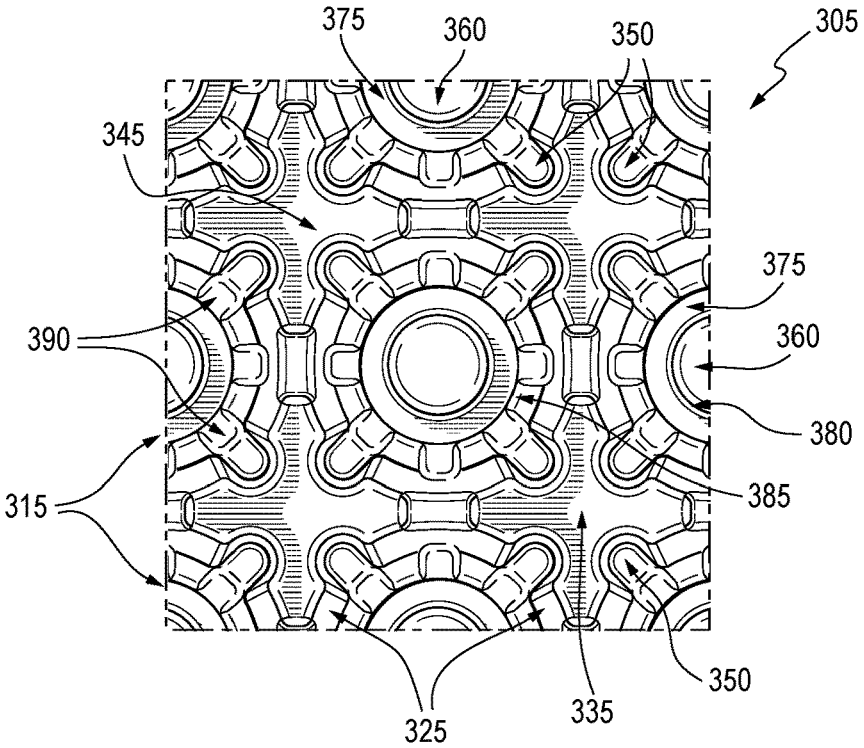
FIG. 15 is an enlarged plan view of a portion of the first side of a wine insert as shown in FIGS. 13 and 14.
Figure 16:
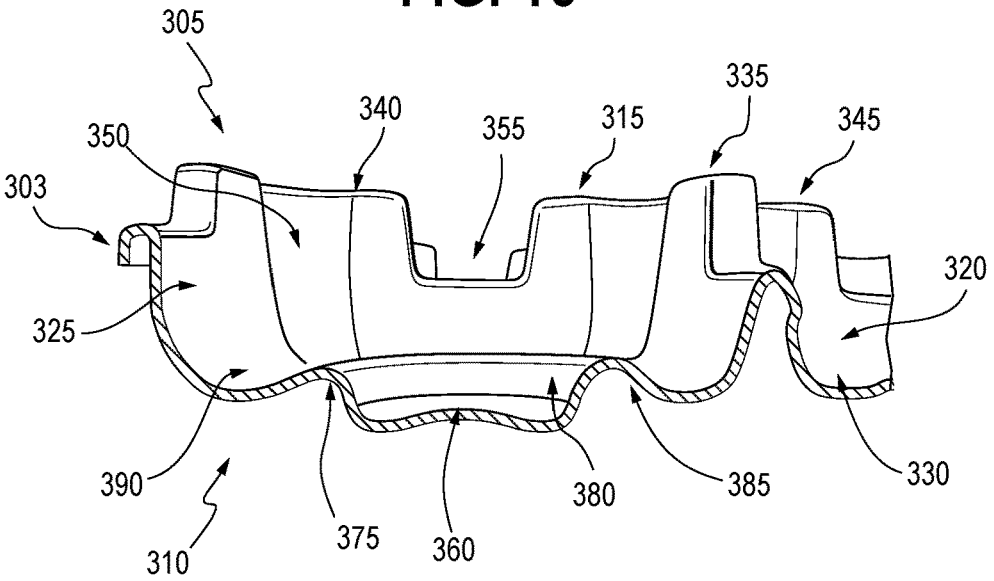
FIG. 16 is an enlarged cross-sectional view of a portion of a wine insert as shown in FIGS. 13-15.
Figure 17:
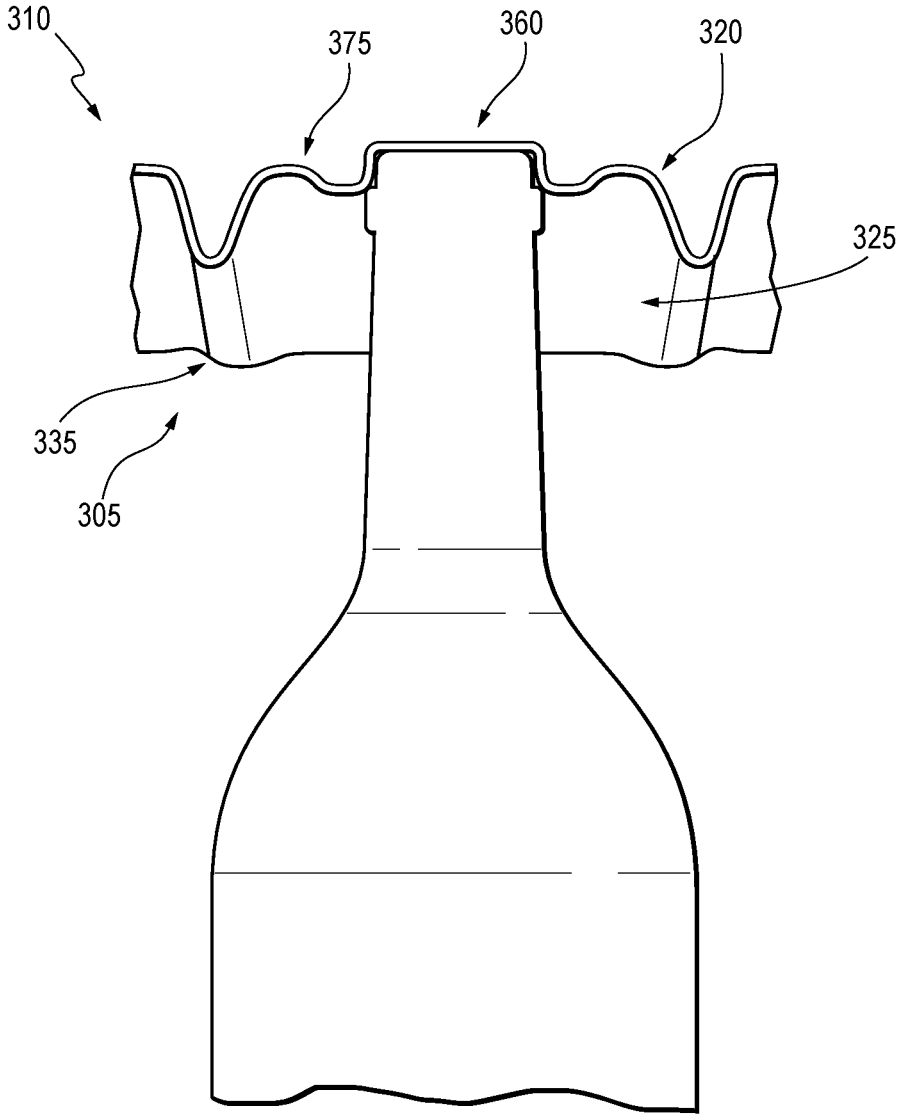
FIG. 17 is a partial cross-sectional view of a portion of the wine insert as shown in FIGS. 13-16 with a neck portion of an individual container placed into the inner well.

An alternative insert 100, is illustrated in FIGS. 6-8. This insert 100 may be used to receive and secure a plurality of wine or other bottle types in a box or other shipping container for shipping. Notably, this insert 100 includes a plurality of identical receptacles 115 for accepting either the top or bottom portion of bottles having different dimensions at the top and bottom thereof. For purposes of this description, it is presumed that the bottles with which the insert 100 is used have a top portion with a first diameter and a bottom portion with a second, larger diameter. As with the other inserts described herein, insert 100 has first side 105 and second side 110. A side skirt 103 extends around the perimeter of the insert 100 between the first 105 and second sides 110. In a preferred embodiment, the receptacles 115 are open toward the first side 105 and partially or totally closed to the second side 110 and are distributed evenly across the insert 100.

Each receptacle 115 includes an outer well 120 formed by a side wall 125. In the illustrated embodiment, the outer well 120 and side wall 125 are cylindrical in order to accommodate cylindrical bottles. However, the outer well 120 and side wall 125 can be readily configured in other cross-sectional shapes, for example rectangular or oval, to accommodate bottles of other shapes. The outer well 120 is open toward the first side 105 of the insert side and at least partially or totally closed toward the second side 110 by a base or bottom surface 130.

The side wall 125 may be composed in part by one or more vertical columns 135. In the illustrated embodiment, four such vertical columns 135 are positioned around the periphery of each outer well 120. Each vertical column 135 forms a portion of the side wall for adjacent outer wells 120. The vertical columns 135 help maintain a uniform distance between adjacent bottles and provide positive placement and alignment for the bottles. In addition, the vertical columns 135 provide additional structural support for the insert 100. When viewed from above the first side 105, vertical columns 140 located around the perimeter of the insert 100 may have a "T"-shape, while those vertical columns 145 located in the interior portion of the insert 100 may have a cross or "X".

Each vertical column 135 is configured with at least one open vertical channel 150. The open vertical channel 150 creates a break in the side wall 125 of the outer well 120. The open vertical channels provide a measure of additional cushioning to the side walls 125 and allows for slight expansion and contraction of the outer well side wall 125 to accommodate slight variations in bottle diameter. The vertical columns 140 located around the perimeter—the "T"-shaped vertical columns—each have two open vertical channels 150, while the vertical columns 145 within the interior of the insert 100 each have four open vertical channels 150. Therefore, each outer well 120 will be bordered by four open vertical channels 150 evenly spaced around its perimeter. In this embodiment, the bases of the open vertical channels extend below the base of the outer wells 120. It may further be seen that the side walls 125 of the each outer well 120 in the illustrated embodiment includes intermediate portions 155 having a height lower than the vertical corner columns 135, Each receptacle 115 further includes an inner well 160 that is preferably arranged to accommodate a top portion of a bottle. As described, the top portion of the bottle has a smaller diameter than the base of the bottle. Thus, the inner well 160 may have a smaller diameter than the outer well 120 and, therefore, may reside entirely within the diameter of the outer well 120. In the illustrated embodiment, the inner well 160 is cylindrical and concentric within the outer well 120. Note that in alternate embodiments that the outer well 120 and inner well 160 may be configured with different shapes to accommodate corresponding bottles. Further, it is possible for the inner well 160 to be offset from the center of the outer well 120 as necessary. In this embodiment, the inner well 160 extends downward toward the second side 110 from the base of the outer well 120. However the inner well 160 does not extend all the way to the second side 110 of the insert 110 to maintain spacing from any packaging surface making contact with the second side 110 of the insert 100.

The base of the outer well 120 also incorporates one or more horizontal open channels 165. In the illustrated embodiment, these horizontal open channels are aligned with the open vertical channels 150. As a result of these horizontal open channels 165, both the wall of the inner well 160 and the base of the outer well 120 are effectively divided into four base sections 170. The top surface of each base section 170 is generally flat and even with each of the top surfaces of the other base sections 170. These top surfaces provide a support for the base portion of each bottle.

In use, two identical inserts 100 would be used to package or store multiple bottles, usually in coordination with a container although various embodiments may be used without coordination to effectuate simple stacking of multiple bottles or similar containers. In the example of use with an exterior container, a first insert 100 would be placed horizontally into one end—preferably already closed—of the container with the first side 105 facing up toward the interior of the container. One or more bottles or similar containers are then placed inside the container with either their respective base or neck portions inserted into the receptacles 115 of the first insert 100. Of note, the bottles may be positioned uniformly with all of the bottles having their base portions—or neck portions—inserted into the receptacles 115 of the first insert 100. Alternately, the bottles may be inserted into the receptacles 115 of the first insert 100 without regard to whether the base or neck portion is being inserted. Once the desired number of bottles have been placed into the box and inserted in the receptacles 115 of the first insert 100. A second insert 100 may then be placed on top of the bottles, taking care to align the upwardly extending portion of the bottles—neck or base—into the receptacles 115 of the second insert 100. Once the bottles are inserted into the receptacles 115 of the second insert 100, the open end of the container adjacent to the second insert 100 may be closed.

FIGS. 9-12 illustrate an insert 200 that shares some similar features with the foregoing version. As such, similar parts are called out in these figures with reference numbers that correspond to those presented above with the change of the leading "1" to a "2". For example, the insert 200 also is provided with a series of receptacles 215 having an outer well 220 and an inner well 260.

Insert 200 includes a plurality of identical receptacles 215 for accepting either the top or bottom portion of bottles having different dimensions at the top and bottom thereof. For purposes of this description, it is presumed that the bottles with which the insert 200 is used have a top portion with a first diameter and a bottom portion with a second, larger diameter. As with the other inserts described herein, insert 200 has first side 205 and second side 210. A side skirt 203 extends around the perimeter of the insert 200 between the first 205 and second sides 210. In a preferred embodiment, the receptacles 215 are open toward the first side 205 and partially or totally closed to the second side 210 and are distributed evenly across the insert 200.

Each receptacle 215 includes an outer well 220 formed by a side wall 225. In the illustrated embodiment, the outer well 220 and side wall 225 are cylindrical in order to accommodate cylindrical bottles. The outer well 220 and side wall 225 can be readily configured in other cross-sectional shapes, for example rectangular or oval, to accommodate bottles of other shapes. The outer well 220 is open toward the first side 205 of the insert side and at least partially or totally closed toward the second side 210 by a base or bottom surface 230.

The side wall 225 may be composed in part by one or more vertical columns 235. In the illustrated embodiment, four such vertical columns 235 are positioned around the periphery of each outer well 220. Each vertical column 235 forms a portion of the side wall for adjacent outer wells 220.

The vertical columns 235 help maintain a uniform distance between adjacent bottles and provide positive placement and alignment for the bottles. In addition, the vertical columns 235 provide additional structural support for the insert 200. When viewed from above the first side 205, vertical columns 240 located around the perimeter of the insert 200 may have a "T"-shape, while those vertical columns 245 located in the interior portion of the insert 200 may have a cross or "X".

Each vertical column 235 is configured with at least one open vertical channel 250. The open vertical channel 250 creates a break in the side wall 225 of the outer well 220. The open vertical channels provide a measure of additional cushioning to the side walls 225 and allows for slight expansion and contraction of the outer well side wall 225 to accommodate slight variations in bottle diameter. The vertical columns 240 located around the perimeter—the "T"-shaped vertical columns—each have two open vertical channels 250, while the vertical columns 245 within the interior of the insert 200 each have four open vertical channels 250. Therefore, each outer well 220 will be bordered by four open vertical channels 250 evenly spaced around its perimeter.

Each receptacle 215 further includes an inner well 260 that is preferably arranged to accommodate a top portion of a bottle. As described, the top portion of the bottle has a small diameter than the base of the bottle. Thus, the inner well 260 may have a smaller diameter than the outer well 220 and, therefore, may reside entirely within the diameter of the outer well 220. In the illustrated embodiment, the inner well 260 is cylindrical and concentric within the outer well 220. Note that in alternate embodiments that the outer well 220 and inner well 260 may be configured with different shapes to accommodate corresponding bottles. Further, it is possible for the inner well 260 to be offset from the center of the outer well 220 as necessary.

Insert 200, the base 230 of the outer well 220 and the inner well 260, in particular, are formed somewhat differently. As with the insert 100, the inner well 260 is concentric with the outer well 220 and extends somewhat downwardly from the base 230 of the outer well 220, although not to the same extent as the inner well 160 of the insert 100. Surrounding the edge of the inner well 260 there is provided a raised annular rib 275. The raised annular rib 275 extends slightly above the remainder of the base 230 of the outer well 220. The inner generally-vertical section 280 of the raised annular rib 275 extends downwardly to form the inner well 260. The outer generally-vertical portion of the raised annular rib 275 transitions to the horizontal base 230 of the outer well 220.

As with insert 100, the inner well, and correspondingly the inner wall of the raised annular rib 280 are configured to accommodate the smaller diameter portion—such as the top or neck portion—of the corresponding bottle. However, the outer wall 285 of the raised annular rib 275 is also configured to fit within the punt or kick-up at the bottom of the bottle and thereby provide additional positional placement and security for the bottle within the outer well 220.

Another difference in insert 200 is that instead of using horizontal open channels 165 that extend below the base 130 of the outer well 120, insert 200 is provided with a series, in the illustrated example, four, radial ribs 290 that extend from the annular rib 275 toward the outer well side well 225. In a preferred embodiment, the vertical height of the radial ribs 290 does not extend above that of the annular rib 275, and advantageously may lie below the height of the annular rib 275 in order to provide clearance for the annular rib 275 to be inserted into the punt or kick-up of the bottom of the bottle. The radial ribs 290 provide additional cushioning for the bottle while also providing additional structural rigidity to the receptacle 215. Insert 200 is utilized in the same manner as described above in connection with insert 100.

FIGS. 13-16 illustrate yet another insert 300 according to the present disclosure. Insert 300 again utilizes many similar features to those of insert 200, and all such features are referenced in the figures with reference numbers that correspond to those presented above with the change of the leading "2" to a "3".

Insert 300 includes a plurality of identical receptacles 315 for accepting either the top or bottom portion of bottles having different dimensions at the top and bottom thereof. As with the other inserts described herein, insert 300 has first side 305 and second side 310. A side skirt 303 extends around the perimeter of the insert 300 between the first 305 and second sides 310. In a preferred embodiment, the receptacles 315 are open toward the first side 305 and partially or totally closed to the second side 310 and are distributed evenly across the insert 300.

Each receptacle 315 includes an outer well 320 formed by a side wall 325. In the illustrated embodiment, the outer well 320 and side wall 325 are cylindrical in order to accommodate cylindrical bottles. The outer well 320 and side wall 325 can be readily configured in other cross-sectional shapes, for example rectangular or oval, to accommodate bottles of other shapes. The outer well 320 is open toward the first side 305 of the insert side and at least partially or totally closed toward the second side 310 by a base or bottom surface 330.

The side wall 325 may be composed in part by one or more vertical columns 335. In the illustrated embodiment, four such vertical columns 335 are positioned around the periphery of each outer well 320. Each vertical column 335 forms a portion of the side wall for adjacent outer wells 320. The vertical columns 335 help maintain a uniform distance between adjacent bottles and provide positive placement and alignment for the bottles. In addition, the vertical columns 335 provide additional structural support for the insert 300. When viewed from above the first side 305, vertical columns 340 located around the perimeter of the insert 300 may have a "T"-shape, while those vertical columns 345 located in the interior portion of the insert 300 may have a cross or "X".

Each vertical column 335 is configured with at least one open vertical channel 350. The open vertical channel 350 creates a break in the side wall 325 of the outer well 320. The open vertical channels provide a measure of additional cushioning to the side walls 325 and allows for slight expansion and contraction of the outer well side wall 325 to accommodate slight variations in bottle diameter. The vertical columns 340 located around the perimeter—the "T"-shaped vertical columns—each have two open vertical channels 350, while the vertical columns 345 within the interior of the insert 300 each have four open vertical channels 350. Therefore, each outer well 320 will be bordered by four open vertical channels 350 evenly spaced around its perimeter.

Each receptacle 315 further includes an inner well 360 that is preferably arranged to accommodate a top portion of a bottle. As described, the top portion of the bottle has a small diameter than the base of the bottle. Thus, the inner well 360 may have a smaller diameter than the outer well 320 and, therefore, may reside entirely within the diameter of the outer well 320. In the illustrated embodiment, the inner well 360 is cylindrical and concentric within the outer well 320. Note that in alternate embodiments that the outer well 320 and inner well 360 may be configured with different shapes to accommodate corresponding bottles. Further, it is possible for the inner well 360 to be offset from the center of the outer well 320 as necessary.

Inner well 360 is concentric with the outer well 320 in the illustrated embodiment. Surrounding the edge of the inner well 360 there is provided a raised annular rib 375. The raised annular rib 375 extends slightly above the remainder of the base 330 of the outer well 320. The inner generally-vertical section 380 of the raised annular rib 375 extends downwardly to form the inner well 360. The outer generally-vertical portion of the raised annular rib 375 transitions to the horizontal base 330 of the outer well 320.

The inner well 320, and correspondingly the inner wall of the raised annular rib 380 are configured to accommodate the smaller diameter portion—such as the top or neck portion—of the corresponding bottle. However, the outer wall 385 of the raised annular rib 375 is also configured to fit within the punt or kick-up at the bottom of the bottle and thereby provide additional positional placement and security for the bottle within the outer well 320.

Insert 300 is provided with a series of radial ribs 390 that extend from the annular rib 375 toward the outer well side well 325. In a preferred embodiment, the vertical height of the radial ribs 390 does not extend above that of the annular rib 375, and advantageously may lie below the height of the annular rib 375 in order to provide clearance for the annular rib 375 to be inserted into the punt or kick-up of the bottom of the bottle. The radial ribs 390 provide additional cushioning for the bottle while also providing additional structural rigidity to the receptacle 315.

Illustrated insert 300 incorporates additional radial ribs 390 to further distribute the weight of the bottle around the receptacle 315. Further, the outer well side walls 325 are somewhat more angled, narrowing the outer well 320 slightly toward the base of the outer well 330. This may result in the portion of the base 330 making contact with the bottom rim of the individual container being narrower than in other embodiments described herein. Again, insert 300 may be used to package or store bottles or similar containers in the same manner as described in connection with insert 100 and insert 200.

Each of the described examples, as well as other contemplated versions of the present disclosure, may be made from a number of suitable materials. Important considerations for material selection include sufficient rigidity to maintain the shape of the insert under the load of multiple bottles while providing sufficient flexibility to allow for slight displacement of portions of the insert, for example the outer well side well, as a bottle is inserted therein to provide a secure fit of the bottle within the outer well. Examples of suitable materials include molded plastic, cardboard, and/or molded pulp. The design of the inserts renders them nestable and stackable for reduced pre-use storage space.

The preferred embodiments of the invention have been described above to explain the principles of the invention and its practical application to thereby enable others skilled in the art to utilize the invention in the best mode known to the inventors. However, as various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by the above-described exemplary embodiment, but should be defined only in accordance with the following claims appended hereto and their equivalents.

What is claimed is:

1. An insert configured for packaging of bottles, each bottle having a neck portion and a bottle portion, comprising:

a first side and a second side;

a plurality of identical receptacles on the first side, the receptacles being evenly distributed about the insert, each receptacle further comprising:

a base;

an outer well open to the first side and having a side wall and a bottom surface, the outer well configured to accommodate the bottom portion of one of the bottles;

an inner well arranged concentrically within the outer well and open to the first side, the inner well configured to accommodate the neck portion of one of the bottles;

a raised annular rib formed within the outer well and forming the inner well; and at least one radial rib formed in the bottom surface of the outer well and extending in a direction from the raised annular rib toward the side wall, wherein a top surface of the radical rib is lower then a top surface of the raised annular rib.

2. The insert configured for packaging of individual containers as set forth in claim 1, wherein the raised annular rib has an outer diameter configured to fit within a depression in the bottom portion of the bottle.

3. The insert configured for packaging of individual containers as set forth in claim 1, further comprising a plurality of vertical columns between adjacent receptacles, the vertical columns forming at least a portion of the side wall of the outer well.

4. The insert configured for packaging of individual containers as set forth in claim 3, wherein at least one of the vertical columns is configured with a cross-shaped cross-section.

5. The insert configured for packaging of individual containers as set forth in claim 3, wherein each vertical column comprises at least one open vertical channel forming a break in the side wall of the outer well.

6. An insert configured for packaging of bottles, each bottle having a neck portion and a bottom portion of different diameters, comprising:

a first side and a second side;

a plurality of identical receptacles open to the first side, the receptacles being evenly distributed about the insert, each receptacle comprising:

an outer well open to the first side, being generally cylindrical and having a side wall and a bottom surface, the outer well configured to accommodate the bottom portion of one of the bottles; and a raised annular rib formed in the bottom surface of the outer well and arranged concentrically within the outer well, the inner well being open to the first side and configured to accommodate the neck portion of one of the bottles; and a plurality of radial ribs formed in the bottom surface of the outer well and extending in a direction from the raised annular rib toward the side wall.

7. The insert configured for packaging of individual containers within as set forth in claim 6, wherein the raised annular rib has an outer diameter configured to fit within a depression in the bottom portion of the bottle.

8. The insert configured for packaging of individual containers as set forth in claim 6, wherein a top surface of each radial rib is lower than a top surface of the raised annular rib.

9. The insert configured for packaging of individual containers as set forth in claim 6, further comprising a plurality of vertical columns between adjacent receptacles, the vertical columns forming a portion of the side wall of the outer well.

10. The insert configured for packaging of individual containers as set forth in claim 9, wherein the vertical column is configured with a cross-shaped cross-section.

11. The insert configured for packaging of individual containers as set forth in claim 9, wherein each vertical column comprises at least one open vertical channel forming a break in the side wall of the outer well.

* * * * *